US010189080B2

(12) United States Patent
Morgenstern et al.

(10) Patent No.: US 10,189,080 B2
(45) Date of Patent: Jan. 29, 2019

(54) METHOD FOR PRODUCING AN ENGINE COMPONENT, ENGINE COMPONENT, AND USE OF AN ALUMINIUM ALLOY

(71) Applicant: FEDERAL-MOGUL NURNBERG GMBH, Nuremberg (DE)

(72) Inventors: Roman Morgenstern, Heilsbronn (DE); Klaus Lades, Nuremberg (DE); Scott Kenningley, Cheadle Hulme (GB); Philipp Koch, Nuremberg (DE); Robert Willard, Nuremberg (DE); Rainer Weiss, Nuremberg (DE); Isabella Sobota, Nuremberg (DE); Martin Popp, Nuremberg (DE)

(73) Assignee: Federal-Mogul Nurnberg, Nuremberg (DE)

( * ) Notice: Subject to any disclaimer, the term of this patent is extended or adjusted under 35 U.S.C. 154(b) by 0 days.

(21) Appl. No.: 15/831,834

(22) Filed: Dec. 5, 2017

(65) Prior Publication Data

US 2018/0093322 A1 Apr. 5, 2018

Related U.S. Application Data

(62) Division of application No. 14/442,615, filed as application No. PCT/EP2013/073812 on Nov. 14, 2013.

(30) Foreign Application Priority Data

Nov. 14, 2012 (DE) ..... 10 2012 220 765

(51) Int. Cl.

| | |
|---|---|
| ***B22D 21/00*** | (2006.01) |
| ***C22C 21/02*** | (2006.01) |
| ***C22C 21/04*** | (2006.01) |
| ***B22D 23/00*** | (2006.01) |
| ***F02F 3/00*** | (2006.01) |

(52) U.S. Cl.

CPC ..... *B22D 21/007* (2013.01); *B22D 23/00* (2013.01); *C22C 21/02* (2013.01); *C22C 21/04* (2013.01); *F02F 3/0084* (2013.01)

(58) Field of Classification Search

CPC ..... C22C 21/02; C22C 21/04; B22D 21/007; B22D 23/00; F02F 3/00894

See application file for complete search history.

(56) References Cited

FOREIGN PATENT DOCUMENTS

EP 2048259 A1 * 4/2009 ..... B21J 5/00

* cited by examiner

*Primary Examiner* — Jessee R Roe

(74) *Attorney, Agent, or Firm* — Robert L. Stearns; Dickinson Wright, PLLC

(57) ABSTRACT

A method for producing an engine component, more particularly a piston for an internal combustion engine, in which an aluminum alloy is cast using the gravity die casting method is provided. The aluminum alloy comprises: 9 to ≤10.5% by weight silicon, >2.0 to <3.5% by weight nickel, >3.7 to 5.2% by weight copper, <1% by weight cobalt, 0.5 to 1.5% by weight magnesium, 0.1 to 0.7% by weight iron, 0.1 to 0.4% by weight manganese, >0.1 to <0.2% by weight zirconium, >0.1 to <0.2% by weight vanadium, 0.05 to <0.2% by weight titanium, 0.004 to 0.008% by weight phosphorus, with aluminum and unavoidable impurities constituting the rest. An engine component, in particular a piston, wherein the engine component consists, at least partially, of the aluminum alloy, and the use of an aluminum alloy to produce the engine component, is also provided.

8 Claims, No Drawings

METHOD FOR PRODUCING AN ENGINE COMPONENT, ENGINE COMPONENT, AND USE OF AN ALUMINIUM ALLOY

CROSS REFERENCE TO RELATED APPLICATIONS

This Divisional Patent Application claims priority to U.S. Utility Patent Application No. 14/442,615, filed May 13, 2015, now U.S. Pat. No. 10,022,788, which claims priority to PCT/EP2013/073812 filed Nov. 14, 2013, which claims priority to DE 102012220765.1 filed Nov. 14, 2012, which is incorporated herein by reference in its entirety.

FIELD OF THE INVENTION

The present invention relates to a method for producing and using an engine component, in particular a piston for an internal combustion engine, in which an aluminium alloy is cast using the gravity die casting method, an engine component consisting at least partially of an aluminium alloy, and the use of an aluminium alloy to produce such an engine component.

PRIOR ART

In recent years, there has been a growing demand for particularly economical and thus ecological means of transport, which have to meet high consumption and emission requirements. There is furthermore always the need to design engines to be as high performance and as low in consumption as possible. Pistons that can be used at increasingly higher combustion temperatures and combustion pressures, which is essentially made possible by increasingly higher performance piston materials, are a decisive factor in the development of high-performance and low-emission internal combustion engines.

A piston for an internal combustion engine fundamentally has to have a high heat resistance and must at the same time be as light and firm as possible. Thereby of particular importance is how the microstructure distribution, the morphology, the composition and the thermal stability of highly heat-resistant phases are configured. An optimisation in this regard normally takes into consideration a minimal content of pores and oxide inclusions.

The sought-after material must be optimised both as regards isothermal fatigue strength (HCF) and as regards thermomechanical fatigue strength (TMF). In order to optimally configure the TMF, the finest possible microstructure of the material should always be strived for. A fine microstructure reduces the risk of the occurrence of microplasticity or microcracks at relatively large primary phases (in particular at primary silicon precipitates) and thus also the risk of crack initiation and crack growth.

Under TMF stress, microplasticities and/or microcracks, which can considerably reduce the lifespan of the piston material, occur at relatively large primary phases, in particular at primary silicon precipitates, owing to the different coefficients of expansion of the individual components of the alloy, namely the matrix and the primary phases. In order to increase the lifespan, it is known to keep the primary phases as small as possible.

In the used gravity die casting, there is a concentration upper limit up to which alloy elements should be introduced, and if this limit is exceeded, the castability of the alloy is reduced or casting becomes impossible. Furthermore, at too high concentrations of strengthening elements the formation of large plate-like intermetallic phases occurs, which drastically reduce the fatigue strength.

DE 44 04 420 A1 describes an alloy that can be used in particular for pistons and for components which are exposed to high temperatures and are subjected to high mechanical stress. The described aluminium alloy comprises 8.0 to 10.0% by weight of silicon, 0.8 to 2.0% by weight of magnesium, 4.0 to 5.9% by weight of copper, 1.0 to 3.0% by weight of nickel, 0.2 to 0.4% by weight of manganese, less than 0.5% by weight of iron as well as at least one element selected from antimony, zirconium, titanium, strontium, cobalt, chromium and vanadium, with at least one of these elements being present in an amount of >0.3% by weight and the sum of these elements being <0.8% by weight.

EP 0 924 310 B1 describes an aluminium/silicon alloy that is used to produce pistons, in particular pistons in internal combustion engines. The aluminium alloy has the following composition: 10.5 to 13.5% by weight of silicon, 2.0 to less than 4.0% by weight of copper, 0.8 to 1.5% by weight of magnesium, 0.5 to 2.0% by weight of nickel, 0.3 to 0.9% by weight of cobalt, at least 20 ppm of phosphorus and either 0.05 to 0.2% by weight of titanium or up to 0.2% by weight of zirconium and/or up to 0.2% by weight of vanadium, with the rest being aluminium and unavoidable impurities.

WO 00/71767 A1 describes an aluminium alloy that is suitable for high temperature applications such as, for example, heavy duty pistons or other uses in internal combustion engines. The aluminium alloy is thereby composed of the following elements: 6.0 to 14.0% by weight of silicon, 3.0 to 8.0% by weight of copper, 0.01 to 0.8% by weight of iron, 0.5 to 1.5% by weight of magnesium, 0.05 to 1.2% by weight of nickel, 0.01 to 1.0% by weight of manganese, 0.05 to 1.2% by weight of titanium, 0.05 to 1.2% by weight of zirconium, 0.05 to 1.2% by weight of vanadium, 0.001 to 0.10% by weight of strontium, with the rest being aluminium.

DE 103 33 103 B4 describes a piston produced from an aluminium cast alloy, said aluminium cast alloy containing: 0.2 or less % by weight of magnesium, 0.05 to 0.3% by weight of titanium, 10 to 21% by weight of silicon, 2 to 3.5% by weight of copper, 0.1 to 0.7% by weight of iron, 1 to 3% by weight of nickel, 0.001 to 0.02% by weight of phosphorus, 0.02 to 0.3% by weight of zirconium, with the rest being aluminium and impurities. It is furthermore described that the size of a non-metal inclusion present within the piston is less than 100 μm.

EP 1 975 262 B1 describes an aluminium cast alloy consisting of: 6 to 9% of silicon, 1.2 to 2.5% of copper, 0.2 to 0.6% of magnesium, 0.2 to 3% of nickel, 0.1 to 0.7% of iron, 0.1 to 0.3% of titanium, 0.03 to 0.5% of zirconium, 0.1 to 0.7% of manganese, 0.01 to 0.5% of vanadium, and one or more of the following elements: 0.003 to 0.05% of strontium, 0.02 to 0.2% of antimony, and 0.001 to 0.03% of sodium, with the total amount of titanium and zirconium being less than 0.5% and aluminium and unavoidable impurities constituting the rest when the total amount is set at 100% by weight.

WO 2010/025919 A2 describes a method for producing a piston of an internal combustion engine, wherein a piston blank is cast from an aluminium/silicon alloy while adding proportions of copper and is then finished. The invention thereby stipulates that the proportion of copper amounts to a maximum of 5.5% of the aluminium/silicon alloy and that proportions of titanium (Ti), zirconium (Zr), chromium (Cr) and/or vanadium (V) are mixed into the aluminium/silicon alloy, and the sum of all of the components is 100%.

The application DE 10 2011 083 969 relates to a method for producing an engine component, in particular a piston for an internal combustion engine, in which an aluminium alloy is cast using the gravity die casting method, as well as to an engine component that consists at least partially of an aluminium alloy, and to the use of an aluminium alloy for producing an engine component. The aluminium alloy thereby comprises the following alloy elements: 6 to 10% by weight of silicon, 1.2 to 2% by weight of nickel, 8 to 10% by weight of copper, 0.5 to 1.5% by weight of magnesium, 0.1 to 0.7% by weight of iron, 0.1 to 0.4% by weight of manganese, 0.2 to 0.4% by weight of zirconium, 0.1 to 0.3% by weight of vanadium, 0.1 to 0.5% by weight of titanium, with the rest being aluminium as well as unavoidable impurities. This alloy preferably has a phosphorus content of less than 30 ppm.

DESCRIPTION OF THE INVENTION

One object of the present invention is to provide a method for producing an engine component, in particular a piston for an internal combustion engine, wherein an aluminium alloy is cast using the gravity die casting method such that a highly heat resistant engine component can be produced using the gravity die casting method.

This object is solved by the method according to claim 1. Further preferred embodiments of the invention are apparent from the sub-claims relating hereto.

It is a further object of the invention to provide an engine component, in particular a piston for an internal combustion engine, which is highly heat resistant and thereby consists at least partially of an aluminium alloy.

This object is solved by the subject matter of claim 8 and further preferred embodiments are apparent from the sub-claims relating hereto.

In a method according to the invention, the aluminium alloy comprises the following alloy elements:

Silicon: 9% by weight to ≤10.5% by weight,

Nickel: >2.0% by weight to <3.5% by weight,

Copper: >3.7% by weight to 5.2% by weight,

Cobalt: to <1% by weight,

Magnesium: 0.5% by weight to 1.5% by weight,

Iron: 0.1% by weight to 0.7% by weight,

Manganese: 0.1% by weight to 0.4% by weight,

Zirconium: >0.1% by weight to <0.2% by weight,

Vanadium: >0.1% by weight to <0.2% by weight,

Titanium: 0.05% by weight to <0.2% by weight,

Phosphorus: 0.004% by weight to 0.008% by weight, with aluminium and unavoidable impurities constituting the rest.

The aluminium alloy preferably comprises:

from >approximately 9≤approximately 10.5, further preferred <approximately 10, particularly preferred <approximately 9.5, or further preferred from approximately 9.5 to approximately 10.5% by weight of silicon;

from >approximately 2.3, further preferred >approximately 3 to <approximately 3.5, or further preferred from approximately 2.5, particularly preferred approximately 2.9 to approximately 3% by weight of nickel;

from >approximately 3.8, further preferred >approximately 4 and particularly preferred >approximately 4.8 to approximately 5.2, or further preferred from >approximately 3.7 to approximately <5, particularly preferred <4, or further preferred of approximately 4, particularly preferred approximately 4.1 to approximately 4.6% by weight of copper;

from >approximately 0.5 and further preferred >approximately 0.9 to <approximately 1% by weight of cobalt;

from approximately 0.5 and further preferred >approximately 0.6 and in particular approximately 0.7 to <approximately 1.5, further preferred <approximately 0.8 or further preferred from >approximately 1, further preferred >approximately 1.3 to approximately 1.5% by weight of magnesium;

from >approximately 0.5, further preferred >approximately 0.6 to approximately 0.7 or further preferred approximately 0.45 to approximately 0.5% by weight of iron;

from approximately 0.1 to <approximately 0.2 or further preferred from >approximately 0.25 to approximately 0.4% by weight of manganese;

from approximately 0.12, further preferred approximately 0.13 to approximately 0.19% by weight of zirconium;

from approximately 0.12 to approximately 0.14% by weight of vanadium;

from approximately 0.05 to <approximately 0.15 or further preferred from approximately 0.11, particularly preferred approximately 0.12, to approximately 0.13% by weight of titanium; and from approximately 0.005 to approximately 0.006% by weight of phosphorus.

Owing to the selected aluminium alloy, it is possible to produce an engine component using the gravity die casting method, which has a high proportion of finely distributed, high-temperature resistant, thermally stable phases and a fine microstructure. Owing to the selection of the alloy according to the invention, the susceptibility to crack initiation and crack growth, for example at oxides or primary phases, and the TMF-HCF lifespan is reduced as compared to the hitherto known methods for producing pistons and similar engine components.

The alloy according to the invention, in particular the comparatively low silicon content, also leads to there being comparatively less and finer primary silicon at least in the thermally highly-stressed bowl rim area of a piston produced in accordance with the invention, such that the alloy leads to particularly good properties of a piston produced in accordance with the invention. A highly heat resistant engine component can thus be produced using the gravity die casting method. The proportions of copper, zirconium, vanadium and titanium as according to the invention, in particular the comparatively high contents of zirconium, vanadium and titanium, produce an advantageous proportion of strengthening precipitates, without, however, causing large plate-like intermetallic phases. The proportions of cobalt and nickel according to the invention are furthermore advantageous for increasing the heat resistance of the alloy. Nickel thereby contributes to forming thermally stable intermetallic phases. Furthermore, cobalt increases the hardness and, in general, the strength of the alloy. Phosphorus, as the nucleating agent, helps to ensure that primary silicon precipitates are precipitated as finely and homogenously distributed as possible.

The aluminium alloy advantageously preferably comprises 0.6% by weight to 0.8% by weight of magnesium, which contributes, in the preferred concentration range, in particular to an efficient formation of secondary strengthening phases without the occurrence of excessive oxide formation. The alloy furthermore alternatively or additionally comprises preferably 0.4% by weight to 0.6% by weight of iron, which reduces the adhesive tendency of the alloy in the casting mould, whereby the formation of plate-like phases remains limited in the cited concentration range.

The weight ratio of iron to manganese in the aluminium alloy is advantageously at most approximately 5:1, preferred approximately 2.5:1. In this embodiment, the aluminium alloy thus contains at most five parts of iron to one part of manganese, preferably approximately 2.5 parts of iron to one part of manganese. Particularly advantageous strength properties of the engine component are achieved with this ratio.

It is furthermore preferred for the total of nickel and cobalt to be >2.0% by weight and <3.8% by weight. The lower limit thereby ensures an advantageous strength of the alloy and the upper limit advantageously ensures a fine microstructure and prevents the formation of course, plate-like phases that would reduce the strength.

The aluminium alloy advantageously has a fine microstructure with a low content of pores and inclusions and/or little and small primary silicon, in particular in the highly-stressed bowl rim area. A low content of pores is thereby preferably to be understood as a porosity of <0.01%, and little primary silicon is to be understood as <1%. The fine microstructure is furthermore advantageously described in that the average length of the primary silicon is approximately <5 μm and the maximum length thereof is approximately <10 μm, and the intermetallic phases and/or primary precipitates have lengths of, on average, approximately <30 μm and at most <50 μm.

It is furthermore preferred for the aluminium alloy, in particular in the bowl rim area, to have an average value of an area of silicon precipitates of <approximately 100 $\mu m^2$ and/or an average value of an area of the intermetallic phases of <approximately 200 $\mu m^2$.

The characterisation of the microstructure of the aluminium alloy preferably occurs by means of quantitative microstructural analysis. A metallographic section is first of all prepared for this purpose and corresponding micrographs are taken using optical microscopy in particular of the particularly technologically important bowl rim area. An inverted light microscope can, as an example, be used herefor. Individual images are then taken therewith at a defined magnification, are assembled by computer into an area (for example 5.5 mm×4.1 mm), and the areas and area proportions of specific phases are determined by means of image processing software.

The fine microstructure in particular contributes to improving the thermomechanical fatigue strength. Limiting the size of the primary phases can reduce the susceptibility to crack initiation and crack growth and thus significantly increase the TMF-HCF lifespan. Owing to the notch effect of pores and inclusions, it is furthermore particularly advantageous to keep the content thereof low.

An engine component according to the invention consists at least partially of one of the aforementioned aluminium alloys. A further independent aspect of the invention lies in the use of the aforementioned aluminium alloy for the production of an engine component, in particular a piston of an internal combustion engine. The discovered aluminium alloy is thereby in particular processed using the gravity die casting method.

EXAMPLES

Cited as examples of the aluminium alloy described above are an alloy 1 having 10.5% by weight of silicon; 3% by weight of nickel; 4.1% by weight of copper; 0.7% by weight of magnesium; 0.5% by weight of iron; 0.2% by weight of manganese; 0.13% by weight of zirconium; 0.12% by weight of vanadium; 0.13% by weight of titanium and 0.006% by weight of phosphorus, an alloy 2 having 9.5% by weight of silicon; 2.9% by weight of nickel; 4.0% by weight of copper; 0.7% by weight of magnesium; 0.45% by weight of iron; 0.2% by weight of manganese; 0.12% by weight of zirconium; 0.12% by weight of vanadium; 0.12% by weight of titanium and 0.006% by weight of phosphorus, and an alloy 3 having 9.5% by weight of silicon; 2.5% by weight of nickel; 4.6% by weight of copper; 0.7% by weight of magnesium; 0.45% by weight of iron; 0.2% by weight of manganese; 0.19% by weight of zirconium; 0.14% by weight of vanadium; 0.11% by weight of titanium and 0.005% by weight of phosphorus, with aluminium and unavoidable impurities in each case constituting the rest.

What is claimed is:

1. A method of producing an engine component by gravity die casting, wherein an aluminium alloy is cast consisting of the following alloy elements:

Silicon: 9% by weight to ≤10.5% by weight,
Nickel: >2.0% by weight to <3.5% by weight,
Copper: >3.7% by weight to 5.2% by weight,
Cobalt: to <1% by weight,
Magnesium: 0.5% by weight to 1.5% by weight,
Iron: 0.1% by weight to 0.7% by weight,
Manganese: 0.1% by weight to 0.4% by weight,
Zirconium: >0.1% by weight to <0.2% by weight,
Vanadium: >0.1% by weight to <0.2% by weight,
Titanium: 0.05% by weight to <0.2% by weight,
Phosphorus: 0.004% by weight to 0.008% by weight,
with aluminium and unavoidable impurities constituting the rest.

2. The method according to claim 1, wherein the magnesium is in the range of 0.6% by weight to 0.8% by weight of magnesium.

3. The method according to claim 1, wherein the iron is in the range of 0.4% by weight to 0.6% by weight of iron.

4. The method according to claim 1, wherein the weight ratio of iron to manganese in the aluminium alloy is at most approximately 5:1.

5. The method according to claim 4, wherein said weight ratio of iron to manganese is approximately 2.5:1.

6. The method according to claim 1, wherein the total of nickel and cobalt is >2.0% by weight and <3.8% by weight.

7. The method according to claim 1, wherein the engine component is a piston that has a bowl rim area and wherein the aluminium alloy has a fine microstructure with a low content of pores and inclusions and/or little and small primary silicon, at least in the bowl rim area, with the porosity being <0.01% and/or the content of primary silicon being <1%, the primary silicon having lengths of, on average, <5 μm and/or maximum lengths of <10 μm, and the intermetallic phases and/or primary precipitates having lengths of, on average, <30 μm and/or maximum lengths of <50 μm.

8. The method according to claim 1, wherein the engine component is a piston that has a bowl rim area and wherein the aluminium alloy, at least in the bowl rim area, has an average value of an area of silicon precipitates of <approximately 100 $\mu m^2$ and/or an average value of an area of the intermetallic phases of <approximately 200 $\mu m^2$.

* * * * *